US005538236A

United States Patent [19]

Nordell

[11] Patent Number: 5,538,236

[45] Date of Patent: Jul. 23, 1996

[54] VACUUM ASSISTED GATE ASSEMBLY FOR THE CARTON BLANK MAGAZINE OF A PACKAGING MACHINE

[75] Inventor: Joakim Nordell, Wheeling, Ill.

[73] Assignee: Tetra Laval Holdings & Finance S.A., Pully, Switzerland

[21] Appl. No.: 315,399

[22] Filed: Sep. 28, 1994

[51] Int. Cl.[6] ..... B65H 3/12

[52] U.S. Cl. ..... 271/94; 271/105; 221/211; 221/259; 493/315

[58] Field of Search ..... 221/211, 259, 221/224, 226, 230, 305; 271/11, 91, 94, 105; 493/315, 316, 317

[56] References Cited

U.S. PATENT DOCUMENTS

| | | | |
|---|---|---|---|
| 2,116,607 | 5/1938 | Milmoe . | |
| 3,064,542 | 11/1962 | Terry . | |
| 3,143,937 | 8/1964 | Martin . | |
| 3,187,646 | 6/1965 | Monroe et al. . | |
| 3,364,826 | 1/1968 | Austin, Jr. et al. . | |
| 3,466,837 | 9/1969 | Sturges . | |
| 4,011,799 | 3/1977 | Chidsey | 493/316 X |
| 4,041,850 | 8/1977 | Reichert . | |
| 4,201,118 | 5/1980 | Calvert et al. . | |
| 4,685,272 | 8/1987 | Kawai et al. . | |
| 5,097,649 | 3/1992 | Ueda et al. . | |
| 5,180,356 | 1/1993 | Wakabayashi et al. . | |
| 5,354,045 | 10/1994 | Boldrini et al. | 271/94 X |

FOREIGN PATENT DOCUMENTS

| | | | |
|---|---|---|---|
| 401621 | 2/1974 | U.S.S.R. | 271/94 X |

*Primary Examiner*—William E. Terrell
*Assistant Examiner*—Dean A. Reichard
*Attorney, Agent, or Firm*—McAndrews, Held & Malloy; Patrick N. Burkhart

[57] ABSTRACT

An improved gate assembly for the carton blank magazine of a packaging machine includes a frame fixedly mounted on the magazine. The frame has a longitudinal opening formed therein for permitting the passage of a single carton blank therethrough. The frame has air ducts extending therethrough and receiving members extending from the air ducts. Each of the receiving members has at least one slot formed in the surface thereof facing the magazine. Each of the receiving members also has an interior channel formed therein for communicating air between the slots and the respective air duct. In operation, negative air pressure applied to the air ducts induces a carton blank from the magazine into contact with the receiving members.

20 Claims, 5 Drawing Sheets

VACUUM ASSISTED GATE ASSEMBLY FOR THE CARTON BLANK MAGAZINE OF A PACKAGING MACHINE

TECHNICAL FIELD

The present invention relates to packaging machines. In particular, the present invention relates to a vacuum assisted gate assembly for introducing carton blanks held in a magazine of the packaging machine.

BACKGROUND OF THE INVENTION

In packaging machines that produce sealed cartons containing food products or liquids, the carton blanks are typically introduced to the machine from a magazine. The magazine usually holds a stack of carton blanks in an unerected and compressed state, and urges the carton blanks toward a gate. The gate positions and holds the carton blanks so they can be picked one at a time by a mechanism that unfolds and erects the blanks to form cartons having side walls and unsealed top and bottom panels. After the bottom panel of the erected carton blank is sealed, a food product or a liquid can be received in the carton, the top panel of the carton can then be formed and sealed, and the filled and sealed carton can be dispensed from the packaging machine for eventual shipment to the consumer.

Many of today's carton blank magazines require the application of high pressure by the magazine's pusher mechanism to overcome the friction of the stack of carton blanks against the interior surfaces of the magazine, and to urge the stack of blanks toward the gate. Under such high pressure, blanks can become compressed to the extent that the blanks can become difficult to separate when they reach the gate. In such instances, two or more carton blanks can be improperly fed simultaneously to the packaging machine, thereby creating the potential for misalignment of the carton blanks in subsequent portions of the packaging machine and fouling of the packaging machine. When carton blanks are misaligned, food product can be wasted if the misalignment persists through the filling area. If the machine becomes fouled, then valuable production time can be lost during the time required to service the machine.

SUMMARY OF THE INVENTION

An improved gate assembly for the carton blank magazine of a packaging machine comprises a frame fixedly mounted on the magazine. The frame has a longitudinal opening formed therein for permitting the passage of a single carton blank therethrough. The frame has at least one air duct extending therethrough and a plurality of receiving members extending from the at least one air duct. Each of the receiving members has at least one slot formed in the surface thereof facing the magazine. Each of the receiving members also has at least one interior channel formed therein for communicating air between the at least one slot and the at least one air duct. In operation, negative air pressure applied to the at least one air duct induces a carton blank from the magazine into contact with the receiving member.

DETAILED DESCRIPTION OF THE PREFERRED EMBODIMENTS

Figure 1:
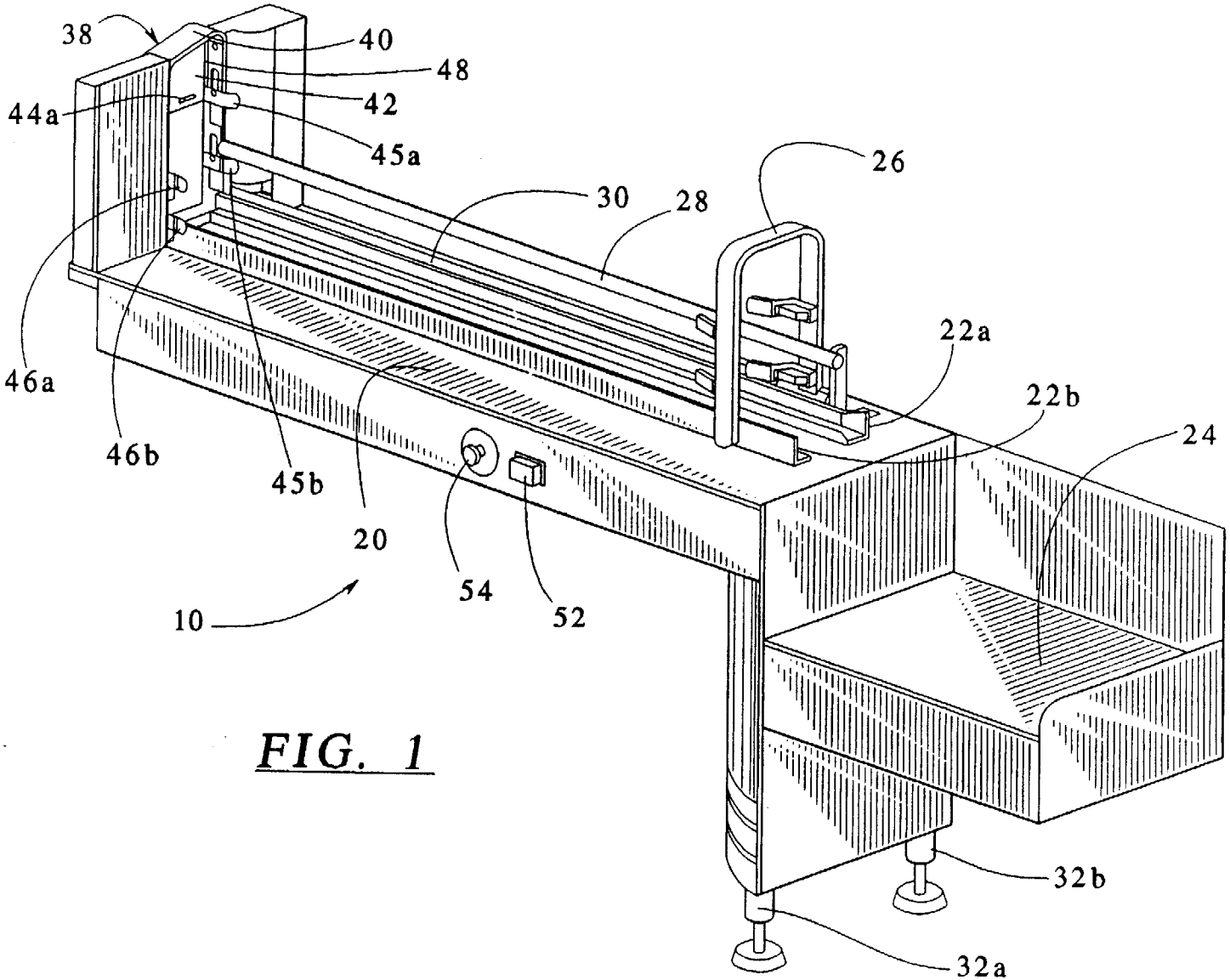
FIG. 1 is a perspective view of a carton blank magazine portion of a packaging machine which includes a vacuum assisted gate assembly.

Turning first to FIG. 1, a carton blank magazine portion 10 of a packaging machine includes a magazine surface 20. Magazine surface 20 has a pair of oppositely facing, generally L-shaped rails 22*a*, 22*b* for receiving and containing a stack of carton blanks above magazine surface 20 and between rails 22*a*, 22*b*. A shelf 24 conveniently supports the carton blanks (not shown in FIG. 1) prior to being loaded between rails 22*a*, 22*b*.

As shown in FIG. 1, magazine 10 further includes a pusher 26 and a gate assembly 38. Pusher 26 is supported above magazine surface 20 by tubular support element 30. Tubular element 28 maintains the alignment of the carton blanks between pusher 26 and gate assembly 38. Pusher 26 is pneumatically biased on tubular element 30 so as to urge a stack of carton blanks loaded between rails 22*a*, 22*b* toward gate assembly 38. Pusher 26 also maintains the stack of carton blanks in an unerected and compressed state prior to their being presented to gate assembly 38.

(3ate assembly 38 includes a frame 40 having a longitudinal opening 48 formed therein for permitting the passage of a single carton blank therethrough. Frame 40 also has a receiving member 42*a* extending therefrom. Receiving member 42*a* has a slot 44*a* formed in the surface thereof facing the magazine. An interior channel (not shown in FIG. 1) is formed in receiving member 42*a* for communicating air between slot 44*a* and an air duct (not shown in FIG. 1) extending through frame 40. Frame 40 also has additional receiving members 42*b*, 42*c* extending therefrom, each of which has an interior channel for communicating air between its slot and an air duct. In operation, negative air pressure applied to the frame air ducts induces a carton blank (not shown in FIG. 1) from the magazine into contact with the receiving members 42*a*, 42*b*, 42*c*.

Stationary guide fingers 46*a*, 46*b* direct carton blanks into proper position with respect to gate assembly 38 as the carton blanks are urged toward gate assembly 38 by pusher 26. When a carton blank is in contact with receiving members 42*a*, 42*b*, 42*c*, a vacuum element of the rotary picker (not shown in FIG. 1) located behind gate assembly 38 laterally displaces the carton blank from gate assembly 38 through longitudinal opening 48. At the same time, moveable guide fingers 45*a*, 45*b* are urged forward by cammed drive members 80*a*, 80*b*, respectively, from their normally rearward positions to uncover opening 48 to permit passage of a single carton blank therethrough. Once displaced through opening 48, the carton blank passes to succeeding portions of the packaging machine where the carton blank is unfolded and erected prior to being filled with a food product or a liquid and then sealed.

In FIG. 1, switch 52 activates the moveable components of magazine 10. Switch 54 deactivates the moveable components of magazine 10 in the event of an emergency or other reason to cease operation of magazine 10.

Figure 2:
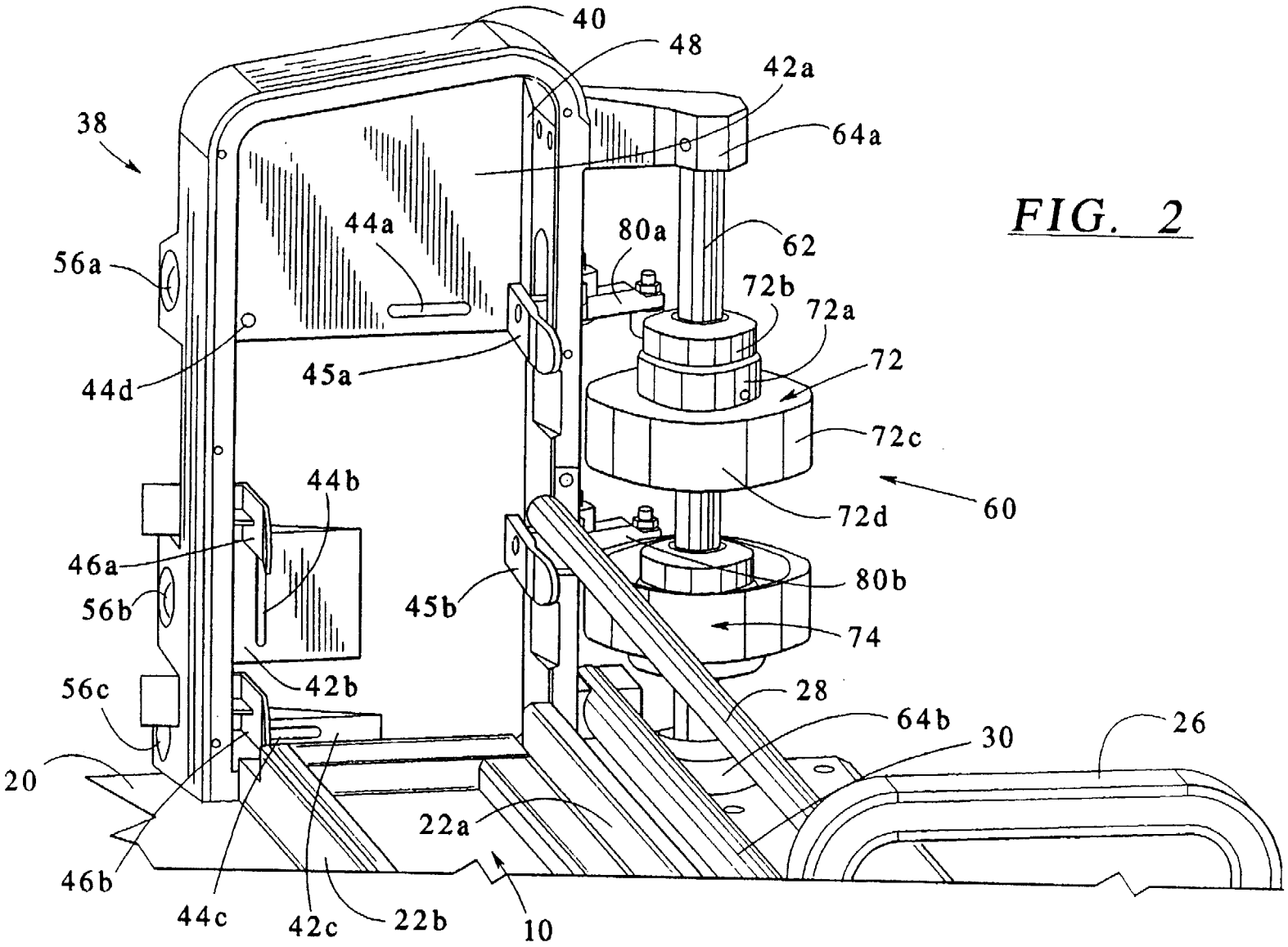
FIG. 2 is an enlarged perspective view of the gate assembly illustrated in FIG. 1.

FIG. 2 is a perspective view of the gate assembly 38 of a carton blank magazine 10 and the adjacent bending cam mechanism 60. The carton blank magazine 10 includes a magazine surface 20. Magazine surface 20 has a pair of oppositely facing, generally L-shaped rails 22*a*, 22*b* for receiving and containing a stack of carton blanks above magazine surface 20 and between rails 22*a*, 22*b*. The magazine 10 further includes a pusher 26 and a gate assembly 38. Pusher 26 is supported above magazine surface 20 by tubular support element 30. Tubular element 28 maintains the alignment of the carton blanks between pusher 26 and gate assembly 38. Pusher 26 is pneumatically biased so as to urge a stack of carton blanks loaded between rails 22*a*, 22*b* toward gate assembly 38. Pusher 26 also maintains the stack of carton blanks in an unerected and compressed state prior to their being presented to gate assembly 38.

As shown in detail in FIG. 2, gate assembly 38 includes a frame 40 fixedly mounted on magazine surface 20. Frame 40 has a longitudinal opening 48 formed therein for permitting the passage of a single carton blank (not shown in FIG. 2) therethrough. Frame 40 has air ducts 56*a*, 56*b*, 56*c* extending therethrough. Receiving members 42*a*, 42*b*, 42*c* extend from air ducts 56*a*, 56*b*, 56*c*, respectively.

Each of receiving members 42*a*, 42*b*, 42*c* has at least one slot formed in the surface thereof facing the magazine 10. As shown in FIG. 2, receiving member 42*a* has slots 44*a*, 44*d*, formed therein. Receiving member 42*b* has a slot 44*b* formed therein. Receiving member 42*c*, has a slot 44*c* formed therein. Each of receiving members 42*a*, 42*b*, 42*c* has at least one channel formed in its interior (not shown in FIG. 2) for communicating air between the slot(s) and the respective air duct. In this regard, a channel formed in the interior of receiving member 42*a* communicates air between slots 44*a*, 44*d* and air duct 56*a*. An interior channel in receiving member 42*b* communicates air between slot 44*b* and air duct 56*b*. An interior channel in receiving member 42*c* communicates air between slot 44*c* and air duct 56*c*.

FIG. 2 shows stationary guide fingers 46*a*, 46*b*, which direct the carton blanks into their proper position with respect to gate assembly 38 as the carton blanks are urged toward gate assembly 38 by pusher 26. Negative air pressure applied to air ducts 56*a*, 56*b*, 56*c* induces a carton blank from the magazine 10 into contact with receiving members 42*a*, 42*b*, 42*c*. The negative air pressure may, for example, be supplied by a fan (not shown in FIG. 2).

When a carton blank is in contact with receiving members 42*a*, 42*b*, 42*c*, a vacuum element of the rotary picker (shown for example in FIG. 3 as vacuum element 282) located behind gate assembly 38 laterally displaces the carton blank from gate assembly 38 through longitudinal opening 48. At the same time, moveable guide fingers 45*a*, 45*b* are urged forward (toward pusher 26) by cammed drive members 80*a*, 80*b* from their normally rearward positions to uncover opening 48 sufficiently to permit passage of a single carton blank through opening 48. The downwardly extending wheel of each of the cammed drive members 80*a*, 80*b* are urged to rotate by the frictional contact of the wheel against drive collar 72*b* secured to rotating shaft 62. Moveable guide fingers 45*a*, 45*b* are urged forward as each carton blank is displaced from gate assembly 38.

As shown in FIG. 2, cam mechanism 60 includes substantially identical first and second cam members 72, 74 mounted on a rotatable shaft 62. Shaft 62 is rotatably mounted between bushings 64*a*, 64*b*. Upper bushing 64*a* is fixedly mounted on and extends laterally from frame 40 of gate assembly 38. Lower bushing 64*b* is fixedly mounted on magazine surface 20.

Cam member 72 in FIG. 2 comprises an annular fastening collar 72*a* for retaining cam member 72 on shaft 62, and an adjacent annular drive collar 72*b* which imparts rotational force to cammed drive member 80*a*. Cam member 72 also comprises longitudinally extending side walls, one of which is designated in FIG. 2 as side wall 72*c*, and apex portions interconnecting the side walls, one of which is designated in FIG. 2 as apex portion 72*d*. Cam member 74 is substantially identical in configuration to cam member 72, and imparts rotational force to cammed drive member 80*b*.

FIG. 2 also shows the respective locations of rails 22*a*, 22*b*, as well as pusher 26 and tubular support elements 28, 30, with respect to gate assembly 38.

Regarding the negative air pressure or vacuum applied to the air ducts, it has been found more advantageous to induce a high air flow, low negative pressure stream to counteract the leakage that occurs when a carton blank is urged laterally away from the slot(s) in the receiving members by the moveable members. In this regard, a low air flow, high negative pressure stream has been found less desirable to maintain carton blanks in contact with the receiving members when the blanks are urged laterally away from the slot(s) by the moveable members, thereby exposing the slot(s) to atmospheric pressure. Both schemes, however, provide negative air pressure for operation of the system, although the first noted scheme is preferred.

Figure 3:
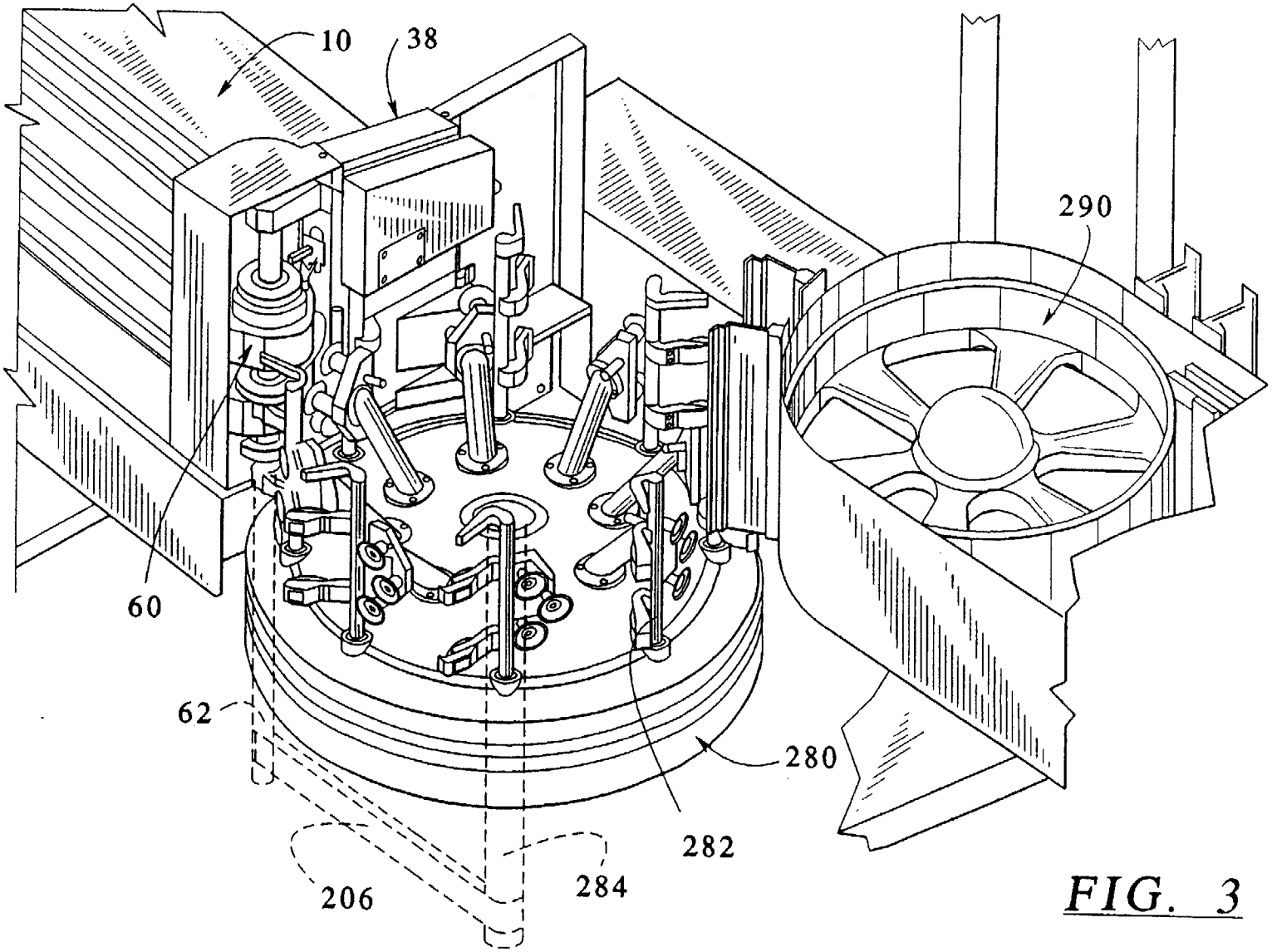
FIG. 3 is a perspective view of the portion of the packaging machine containing the carton blank magazine including the gate assembly, the bending cam mechanism, the rotary picker including the vacuum elements for displacing the carton blanks from the magazine, and the erected carton blank receiving conveyor.
Figure 4:
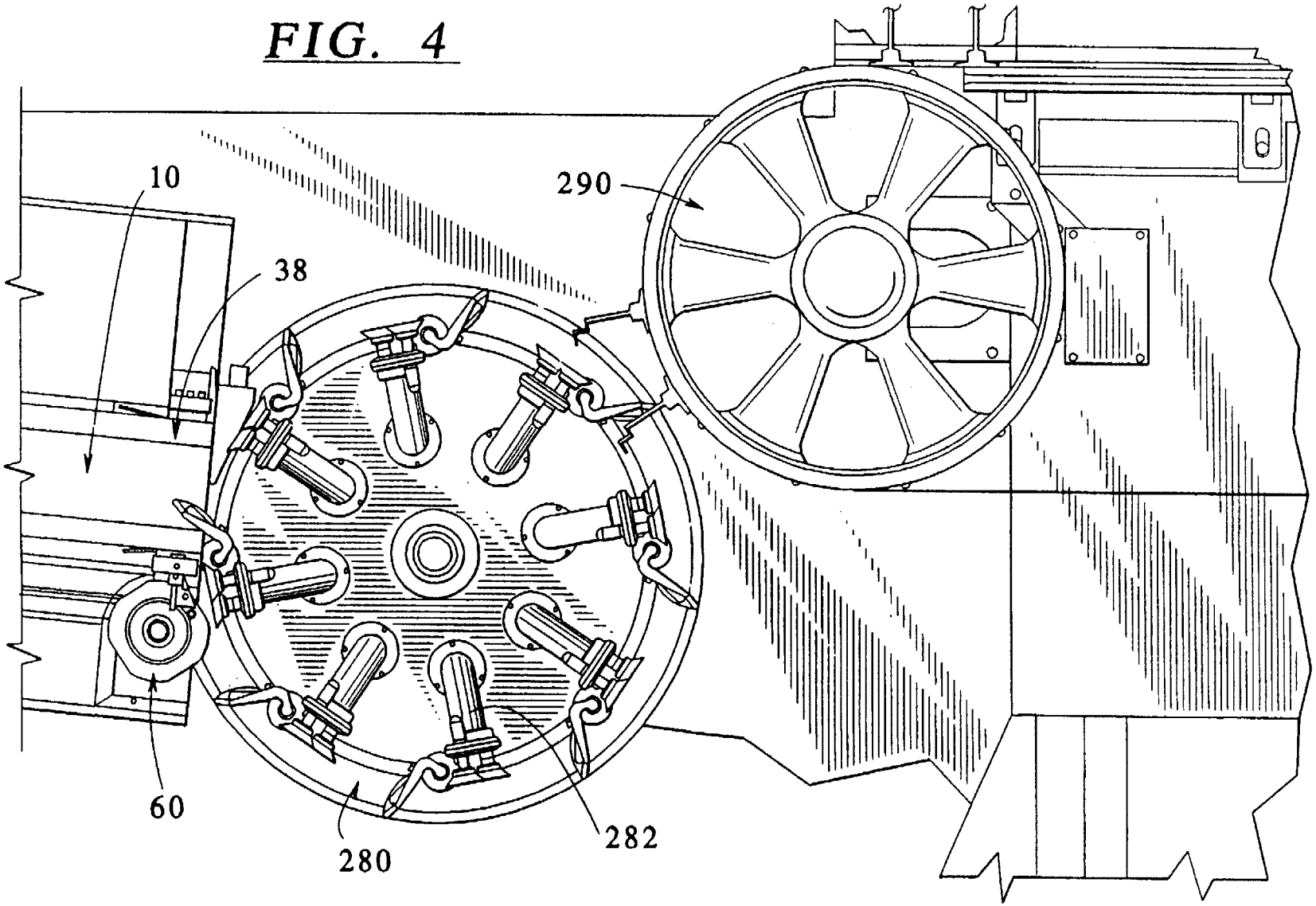
FIG. 4 is a top plan view of the portion of the packaging machine containing the carton blank magazine, bending cam mechanism, rotary picker, and erected carton blank receiving conveyor illustrated in FIG. 3.

FIGS. 3 and 4 show the portion of the packaging machine containing the carton blank magazine 10 including gate assembly 38, bending cam mechanism 60, rotary picker 280 including vacuum elements 282 for displacing carton blanks (not shown in FIGS. 3 and 4) away from magazine 10, and erected carton blank receiving conveyor 290. As shown in FIG. 3, a band 286 interconnects shaft 62, which extends from bending cam mechanism 60, and shaft 284, which extends from rotary picker 280. Band 286 synchronizes the rotation of shaft 62 with that of rotary picker 280.

Figure 5:
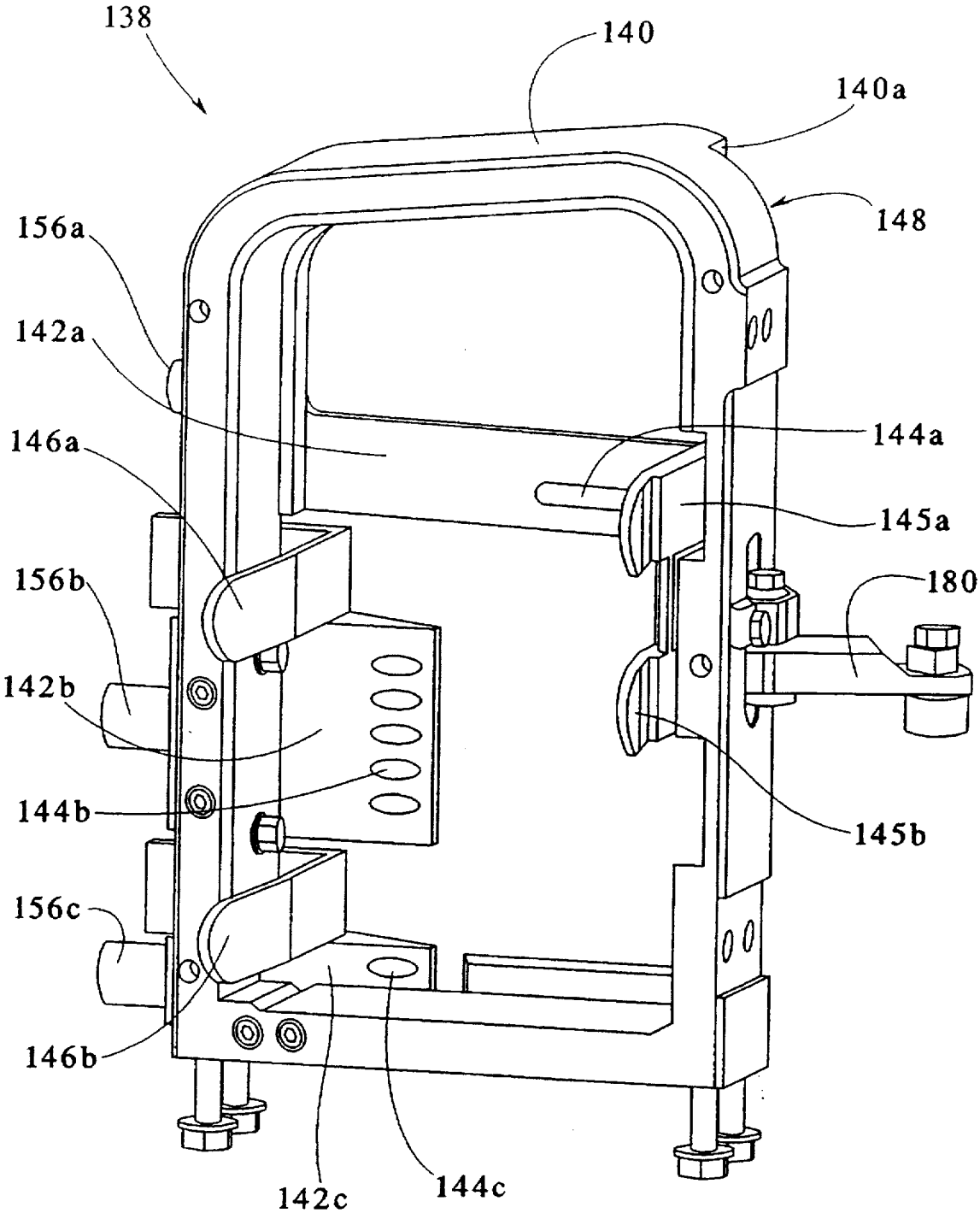
FIG. 5 is an enlarged perspective view of another embodiment of a vacuum assisted gate assembly for use in conjunction with a smaller capacity carton than that for the gate assembly of FIGS. 1 and 2.

FIG. 5 illustrates another embodiment of a vacuum assisted gate assembly 138 suitable for use in conjunction with a smaller capacity carton (not shown in FIG. 5) than that for gate assembly 38 of FIGS. 1 and 2. As shown in FIG. 5, gate assembly 138 includes a frame 140 which is fixedly mounted at the end of a carton blank magazine of the type shown as magazine 10 in FIGS. 1 and 2. Frame 140 has a cut-out portion 140*a* which forms a longitudinal opening 148 for permitting the passage of a single carton blank therethrough. Frame 140 has air ducts 156*a*, 156*b*, 156*c* extending therethrough. Receiving members 142*a*, 142*b*, 142*c* extend from air ducts 156*a*, 156*b*, 156*c*, respectively.

Each of receiving members 142*a*, 142*b*, 142*c* has at least one slot formed in the surface thereof facing the magazine. As shown in FIG. 2, receiving member 142*a* has slot 144*a* formed therein. Receiving member 142*b* has five slots formed therein, one of which is designated in FIG. 5 as slot 144*b*. Receiving member 142*c* has a slot 144*c* formed therein. Each of receiving members 142*a*, 142*b*, 142*c* has at least one channel formed in its interior (not shown in FIG. 5) for communicating air between the slot(s) and the respective air duct. In this regard, a channel formed in the interior of receiving member 142*a* communicates air between slot 144*a* and air duct 156*a*. An interior channel in receiving member 142*b* communicates air between slot 144*b* and air duct 156b. An interior channel in receiving member 142c communicates air between slot 144c and air duct 156c.

FIG. 5 shows stationary guide fingers 146a, 146b, which direct the carton blanks into their proper position with respect to gate assembly 138 as the carton blanks are urged toward gate assembly 138 by pusher 126. Negative air pressure applied to air ducts 156a, 156b, 156c induces a carton blank from the magazine (not shown in FIG. 5) into contact with receiving members 142a, 142b, 142c. The negative air pressure may, for example, be supplied by a fan (not shown in FIG. 5).

When a carton blank is in contact with receiving members 142a, 142b, 142c, a vacuum element of the rotary picker (shown for example in FIG. 3 as vacuum element 282) located behind gate assembly 138 laterally displaces the carton blank from gate assembly 138 through longitudinal opening 148. At the same time, moveable guide fingers 145a, 145b are urged forward (toward the pusher) by cammed drive member 180 from their normally rearward positions to uncover opening 148 sufficiently to permit passage of a single carton blank through opening 148. The downwardly extending wheel of cammed drive member 180 is urged to rotate by the frictional contact of the wheel against a drive collar secured to the rotating shaft of the adjacent bending cam mechanism (not shown in FIG. 5). Moveable guide fingers 145a, 145b are urged forward as each cannon blank is displaced from gate assembly 138.

Negative air pressure applied to air ducts 156a, 156b, 156c induces a carton blank from the adjacent magazine (not shown in FIG. 5) into contact with receiving members 142a, 142b, 142c. The negative air pressure may, for example, be supplied by a fan (not shown in FIG. 5).

Regarding the location of the receiving members and their respective slots, it has been found advantageous to locate the slots so that the carton blank is vacuum gripped in a substantially balanced manner. In this regard, the vacuum gripping of a carton blank by slots on one edge of the blank should preferably be offset by vacuum gripping by slots on an opposite edge so that the carton blank maintains its alignment within the gate assembly.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A gate assembly for the carton blank magazine of a packaging machine comprising a frame fixedly mounted on said magazine and defining sides of a carton blank open region in which carton blanks enter the frame in a first direction, said frame having a longitudinal slot formed therein for permitting the passage of a single carton blank therethrough in a second direction generally perpendicular to the first direction, said frame having at least one air duct extending therethrough and at least one receiving member extending from said at least one air duct, each of said at least one receiving member having at least one air slot formed in the surface thereof facing the magazine and at least one interior channel formed therein for communicating air between said at least one slot and said at least one air duct, means for generating a negative air pressure to said at least one air duct to thereby induce removal of a carton blank from said magazine into contact with said at least one receiving member in the first direction to facilitate positioning the carton blank for further removal through said longitudinal slot in the second direction.

2. The gate assembly of claim 1 wherein said at least one air duct comprises a plurality of air ducts.

3. The gate assembly of claim 1 wherein said at least one receiving member comprises a plurality of receiving members.

4. The gate assembly of claim 1 wherein said at least one air slot comprises a plurality of air slots.

5. The gate assembly of claim 4 wherein said at least one interior channel comprises a plurality of interior channels.

6. The gate assembly of claim 1 wherein said negative air pressure is supplied by a fan.

7. The gate assembly of claim 1 and further comprising means for selectively releasing single ones of said carton blanks into contact with the receiving member.

8. The gate assembly of claim 7 and further wherein the means for selectively releasing comprises at least one movable guide member disposed proximate the frame and selectively widening the effective size of the carton blank opening.

9. A gate assembly for the carton blank magazine of a packaging machine comprising a frame fixedly mounted on said magazine and defining sides of a carton blank open region and a longitudinal slot formed therein for permitting the passage of a single carton blank therethrough from said carton blank open region, said frame having at least one air duct extending therethrough and at least one receiving member extending from said at least one air duct, said at least one receiving member having a plurality of air slots formed in the surface thereof facing the magazine and at least one interior channel formed therein for communicating air between said at least one slot and said at least one air duct, whereby negative air pressure applied to said at least one air duct induces a carton blank from said magazine into contact with said at least one receiving member to position the carton blank for further removal through said longitudinal slot.

10. A gate assembly for the carton blank magazine of a packaging machine comprising:

a frame fixedly mounted on said magazine and defining sides of a carton blank open region, the frame having a longitudinal slot formed therein for permitting passage of a single carton blank therethrough from said carton blank open region;

a plurality of receiving members extending from said frame, each of said plurality of receiving members having at least one air slot formed in the surface thereof facing the magazine;

the frame and the plurality of receiving members including a plurality of air channels to facilitate generation of an underpressure at the air slots, whereby an underpressure at the air slots induces a carton blank into said carton blank open region from said magazine and into contact with said plurality of receiving members to position the carton blank for further removal through said longitudinal slot.

11. A gate assembly for the carton blank magazine of a packaging machine comprising:

a frame fixedly mounted on said magazine and defining sides of a carton blank open region, the frame having a longitudinal slot formed therein for permitting passage of a single carton blank therethrough from said carton blank open region;

at least one receiving member extending from said frame, the receiving member having a plurality of air slots formed in the surface thereof facing the magazine;

the frame and the receiving member including at least one air channel to facilitate generation of an underpressure at the air slots, whereby an underpressure at the air slots induces a carton blank into said carton blank open region from said magazine and into contact with said at least one receiving member to position the carton blank for further removal through said longitudinal slot.

12. A gate assembly for the carton blank magazine of a packaging machine comprising:

a frame fixedly mounted on said magazine and defining sides of a carton blank open region, the frame having a longitudinal slot formed therein for permitting passage of a single carton blank therethrough from said carton blank open region;

at least one receiving member extending from said frame, the receiving member having at least one air slot formed in the surface thereof facing the magazine;

the frame and the receiving member including at least one air channel to facilitate generation of an underpressure at the air slots, whereby an underpressure at the at least one air slot induces a carton blank into said carton blank open region from said magazine and into contact with said at least one receiving member to position the carton blank for further removal through said longitudinal slot.

13. The gate assembly of claim 12 and further comprising means for selectively releasing single ones of said carton blanks into contact with the at least one receiving member.

14. The gate assembly of claim 13 and further wherein the means for selectively releasing comprises at least one movable guide member disposed proximate the frame and selectively widening the effective size of the carton blank open region.

15. The gate assembly of claim 9 and further comprising means for selectively releasing single ones of said carton blanks into contact with the at least one receiving member.

16. The gate assembly of claim 15 and further wherein the means for selectively releasing comprises at least one movable guide member disposed proximate the frame and selectively widening the effective size of the carton blank open region.

17. The gate assembly of claim 10 and further comprising means for selectively releasing single ones of said carton blanks into contact with plurality of receiving members.

18. The gate assembly of claim 17 and further wherein the means for selectively releasing comprises at least one movable guide member disposed proximate the frame and selectively widening the effective size of the carton blank open region.

19. The gate assembly of claim 11 and further comprising means for selectively releasing single ones of said carton blanks into contact with the at least one receiving member.

20. The gate assembly of claim 19 and further wherein the means for selectively releasing comprises at least one movable guide member disposed proximate the frame and selectively widening the effective size of the carton blank open region.

* * * * *

UNITED STATES PATENT AND TRADEMARK OFFICE

CERTIFICATE OF CORRECTION

PATENT NO. : 5,538,236
DATED : July 23, 1996
INVENTOR(S) : Joakim Nordell

It is certified that error appears in the above-indentified patent and that said Letters Patent is hereby corrected as shown below:

IN COLUMN 2, LINE 37

Cancel "(3ate" and insert --Gate-- therefor.

IN COLUMN 5, LINE 27

Cancel "cannon" and insert --carton-- therefor.

Signed and Sealed this

Thirty-first Day of December, 199

*Attest:*

*Attesting Officer*

Bruce Lehman

BRUCE LEHMAN

*Commissioner of Patents and Trademarks*